US009090385B2

(12) United States Patent
Blagojevic

(10) Patent No.: US 9,090,385 B2
(45) Date of Patent: Jul. 28, 2015

(54) SEALABLE CONTAINER

(71) Applicant: Stevan Blagojevic, Eugene, OR (US)

(72) Inventor: Stevan Blagojevic, Eugene, OR (US)

( * ) Notice: Subject to any disclaimer, the term of this patent is extended or adjusted under 35 U.S.C. 154(b) by 0 days.

(21) Appl. No.: 14/337,119

(22) Filed: Jul. 21, 2014

(65) Prior Publication Data

US 2015/0021216 A1 Jan. 22, 2015

Related U.S. Application Data

(60) Provisional application No. 61/856,410, filed on Jul. 19, 2013, provisional application No. 61/988,745, filed on May 5, 2014, provisional application No. 62/026,877, filed on Jul. 21, 2014.

(51) Int. Cl.

| | |
|---|---|
| ***B65D 53/00*** | (2006.01) |
| ***F42B 39/26*** | (2006.01) |
| ***A24F 15/00*** | (2006.01) |

(52) U.S. Cl.

CPC ..... *B65D 53/00* (2013.01); *A24F 15/00* (2013.01); *F42B 39/26* (2013.01)

(58) Field of Classification Search

CPC ..... B65D 53/00; F42B 39/26; A24F 15/00
USPC ..... 206/3, 269, 265, 443, 223; 220/361
See application file for complete search history.

(56) References Cited

U.S. PATENT DOCUMENTS

| | | | | | |
|---|---|---|---|---|---|
| 2,727,547 | A | * | 12/1955 | Moon | 220/555 |
| 2,928,530 | A | | 3/1960 | Sauey | |
| 3,215,304 | A | * | 11/1965 | Rohe | 429/176 |
| 3,458,079 | A | * | 7/1969 | Gasbarra | 220/787 |
| 3,593,873 | A | * | 7/1971 | Vonk | 220/507 |
| 3,696,957 | A | | 10/1972 | Van Baarn | |
| 4,194,657 | A | * | 3/1980 | Thor | 224/667 |
| 4,241,864 | A | * | 12/1980 | Kessler | 229/5.5 |
| 4,334,631 | A | | 6/1982 | Ballester | |
| 4,387,805 | A | * | 6/1983 | Lanius | 206/230 |
| 4,566,588 | A | * | 1/1986 | Kataczynski | 206/3 |
| 4,757,894 | A | * | 7/1988 | Schreckenstein | 206/3 |
| 4,942,991 | A | * | 7/1990 | Lyons | 224/196 |
| D329,140 | S | * | 9/1992 | Maricle | D3/225 |
| 5,215,207 | A | * | 6/1993 | Stolzman | 220/359.4 |

(Continued)

OTHER PUBLICATIONS

Nov. 12, 2014, International Search Report of the International Searching Authority from the U.S. Receiving Office, in PCTUS2014047488, which is another application of inventor Stevan Blagojevic.

(Continued)

*Primary Examiner* — Steven A. Reynolds
(74) *Attorney, Agent, or Firm* — Kolisch Hartwell, P.C.

(57) ABSTRACT

An embodiment of a container may comprise a cap and a body. The cap may include a top portion, cap walls that form an outer perimeter, and a protruding end that forms an inner perimeter sized smaller than the outer perimeter. The body may include a bottom portion and body walls with distal outermost ends that form a cavity and a body perimeter. The body perimeter may be substantially the same as the outer perimeter. The body may also include upper outer and inner rims disposed around the entire distal outermost ends and having a channel between them. The channel may be sized to receive the protruding end in a friction seal when the container is in a closed position. No portion of the cap may be configured to extend into the cavity or beyond the body perimeter in the closed position.

17 Claims, 7 Drawing Sheets

(56) References Cited

U.S. PATENT DOCUMENTS

| | | | | | |
|---|---|---|---|---|---|
| 5,231,850 | A | * | 8/1993 | Morris | 62/457.6 |
| D353,043 | S | * | 12/1994 | Stewart | D3/228 |
| 5,570,588 | A | * | 11/1996 | Lowe | 62/457.7 |
| 5,680,946 | A | | 10/1997 | Cochran | |
| 5,875,918 | A | * | 3/1999 | Sheffler et al. | 220/783 |
| 6,250,494 | B1 | | 6/2001 | Diamond | |
| 6,962,338 | B2 | * | 11/2005 | Moidu | 277/316 |
| 8,083,094 | B2 | | 12/2011 | Caulfield et al. | |
| 8,448,814 | B2 | | 5/2013 | Yamamoto et al. | |
| 2004/0173613 | A1 | | 9/2004 | Schroeder et al. | |
| 2005/0116003 | A1 | * | 6/2005 | Butler et al. | 224/604 |
| 2010/0193533 | A1 | | 8/2010 | Roesler | |
| 2011/0233076 | A1 | | 9/2011 | Potterfield et al. | |

OTHER PUBLICATIONS

Nov. 12, 2014, Written Opinion of the International Searching Authority from the U.S. Receiving Office, in PCTUS2014047488, which is another application of inventor Stevan Blagojevic.

Cabela's, photographs of ammunition box (big box), Applicant indicates to consider it as if prior art but date is unknown, circa before Jul. 18, 2013.

Cabela's, photographs of ammunition box (little box), Applicant indicates to consider it as if prior art but date is unknown, circa before Jul. 18, 2013.

Unknown author, photographs of storage box with slats (purple box), Applicant indicates to consider it as if prior art but date is unknown, circa before Jul. 18, 2013.

Unknown author, photographs of closable capsule (1 of 2), Applicant indicates to consider it as if prior art but date is unknown, circa before Jul. 18, 2013.

Unknown author, photographs of closable capsule (2 of 2), Applicant indicates to consider it as if prior art but date is unknown, circa before Jul. 18, 2013.

* cited by examiner

SEALABLE CONTAINER

CROSS-REFERENCE TO RELATED APPLICATIONS

This application claims priority from U.S. Provisional Patent Application Ser. No. 61/856,410, filed Jul. 19, 2013; 61/988,745, filed May 5, 2014; and 62/026,877, filed Jul. 21, 2014, all of which is hereby incorporated by reference.

INTRODUCTION

The present disclosure relates to systems and methods related to sealable containers for varying uses. There are many scenarios when a person would wish to keep an item or items protected, organized, dry, and portable. Outdoor and work activities in wet or dirty environments such as camping, fishing, or hunting, would present many opportunities where a container that could achieve such features would be useful, for example to hold ammunition or fire-starting materials. Such a container could also be useful in daily life, for example, to hold make-up, art supplies, or cigarettes and matches.

SUMMARY

Systems and methods of the present disclosure may be related to a sealable container. An embodiment of a container of the present disclosure may include a cap and a body. The cap may include a top portion, cap walls that extend from the top portion and form an outer perimeter, and a protruding end, extending from the cap walls in an opposite direction from the top portion, the protruding end forming an inner perimeter that is sized smaller than the outer perimeter. The body may include a bottom portion, body walls extending from the bottom portion from proximal ends of the body walls to distal outermost ends of the body walls, the body walls forming a cavity on an inner side and a body perimeter on an outer side, the body perimeter having a substantially consistent size between the proximal and distal outermost ends and being sized substantially the same as the outer perimeter. The body may also include an upper outer rim formed around outermost edges of the distal outermost ends, and an upper inner rim formed around inner edges of the distal outermost ends. The upper outer and inner rims may be disposed around the entire distal outermost ends and have a channel between the upper outer and inner rims, the channel being sized to receive the protruding end in a friction seal when the container is in a closed position. No portion of the cap may be configured to extend into the cavity or beyond the body perimeter in the closed position.

An embodiment of a container of the present disclosure may include a cap and a body. The cap may have a ridge extending from a bottom edge of the cap. The ridge may have a first set of sealers disposed circumferentially around the ridge on an exterior side of the ridge and a second set of sealers disposed circumferentially around the ridge on an interior side of the ridge. The body may have a channel proximate an upper outer rim of the body and the channel may have a set of guides disposed at an opening of the channel. The container may be adapted to have a closed position where the cap is placed on the body such that the ridge is inserted into the channel guided by the guides and the sealers create a friction seal with interior sides of the channel.

An embodiment of a container of the present disclosure may include a cap and a body. The cap may include a top portion, cap walls that extend from the top portion and form an outer perimeter, and a protruding end, extending from the cap walls in an opposite direction from the top portion, the protruding end forming an inner perimeter that is sized smaller than the outer perimeter. The protruding end may have one or more first friction sealer(s) disposed on a first side of the protruding end and one or more second friction sealer(s) disposed on a second side of the protruding end that is opposite the first side. The body may include a bottom portion, body walls extending from the bottom portion from proximal ends of the body walls to distal outermost ends of the body walls, the body walls forming a cavity on an inner side and a body perimeter on an outer side. The body perimeter may have a substantially consistent size between the proximal and distal outermost ends and may be sized substantially the same as the outer perimeter. The body may also include an upper outer rim formed around outermost edges of the distal outermost ends and having a first guide adapted to guide the protruding end from an unclosed position to a closed position, and an upper inner rim formed around innermost edges of the distal outermost ends having a second guide adapted to guide the protruding end from the unclosed position to the closed position. The upper outer and inner rims may be disposed around the entire distal outermost ends and have a channel between the upper outer and inner rims. The channel may be sized to receive the protruding end in a friction seal when the container is in the closed position. In the closed position, the cap and the body may form a flush fit, the cavity may be waterproof and airtight, and no portion of the cap may be configured to extend into the cavity or beyond the body perimeter in the closed position.

BRIEF DESCRIPTION

Advantages of the present disclosure will be more readily understood after considering the drawings and the Detailed Description.

The drawings illustrate embodiments and schematic concepts for one or more containers according to the present disclosure. The purpose of these drawings is to aid in explaining the principles of the present disclosure. Thus, the drawings should not be considered as limiting the scope of the present disclosure to the embodiments and schematic concepts shown therein. Other embodiments of containers may be created which follow the principles of the present disclosure as taught herein, and these other embodiments are intended to be included within the scope of the present disclosure.

DETAILED DESCRIPTION

Figure 1:
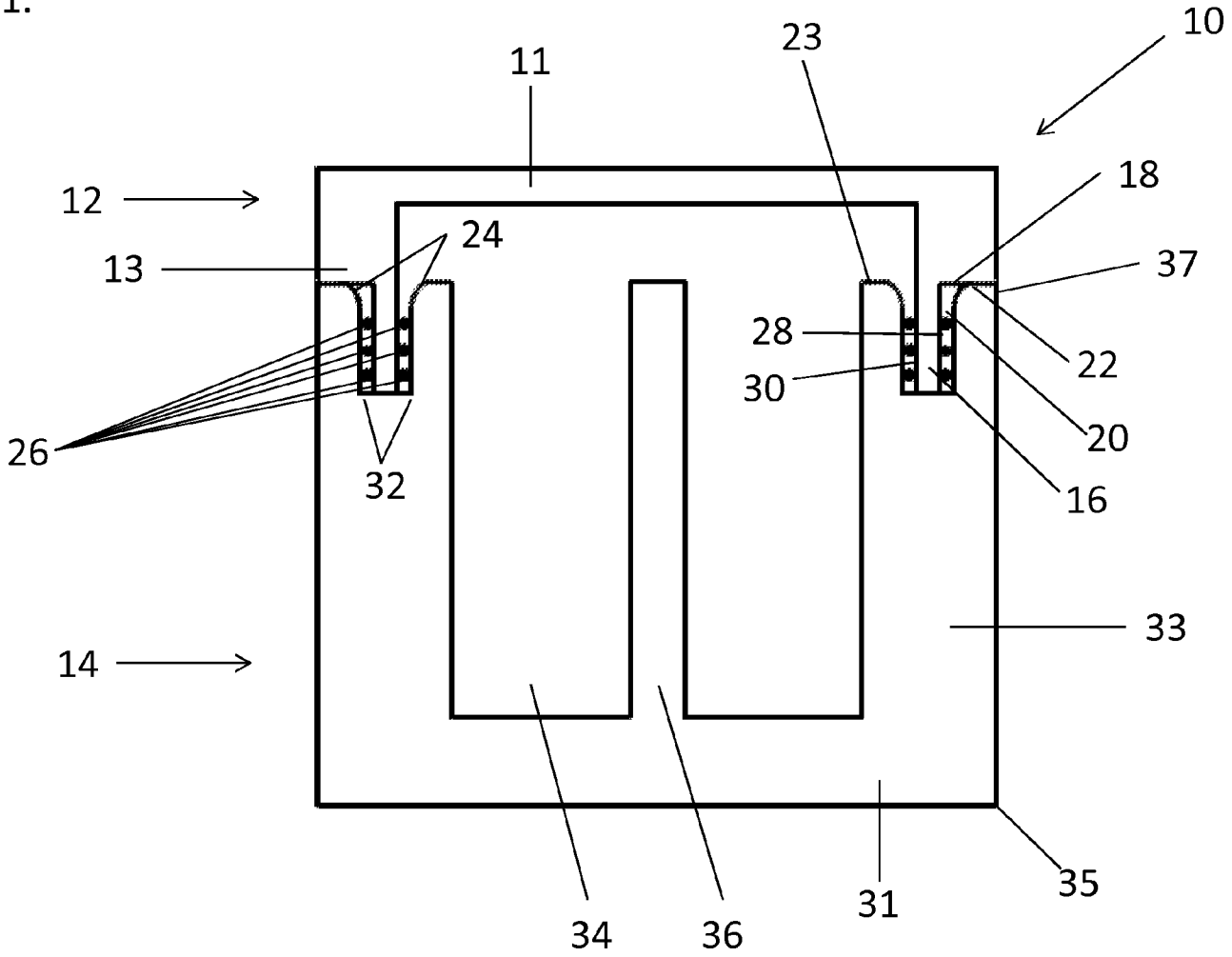
FIG. 1 shows a schematic illustration of an embodiment of a container according to the present disclosure.

Turning to FIG. 1, a container 10 of the present disclosure may include a cap 12 and a body 14. Cap 12 may have a top portion 11 and cap walls 13 that extend from top portion 11. These cap walls may form an outer perimeter (see, for example, FIG. 2). Cap 12 may have a ridge or protruding end 16 extending from proximate a bottom 18 of cap walls 13 in an opposite direction from top portion 11. Protruding end 16 may form an inner perimeter that is sized smaller than the outer perimeter (see, for example, FIGS. 2 and 11).

Body 14 may have a bottom portion 31 and body walls 33 extending from bottom portion 31 from proximal ends 35 to distal outermost ends 37. Body walls 33 may form a cavity on an inner side and a body perimeter on an outer side (see, for example, FIGS. 2 and 11). The body perimeter may have a substantially consistent size and may be substantially the same size as the outer perimeter of cap 12. By "substantially" it is meant within the tolerances of whatever manufacturing technique is used.

Body 14 may have an upper outer rim 22 formed around outermost edges of distal outermost ends 37. Body 14 may have an upper inner rim 23 formed around inner edges of distal outermost ends 37. Upper outer rim 22 and upper inner rim 23 may be disposed around the entire distal outermost ends 37 and may have a channel 20 between upper outer rim 22 and upper outer rim 23.

When container 10 is in a closed position the cap 12 may be placed on the body 14 so that ridge 16 is inserted into channel 20. There may be a first guide 24 proximate upper outer rim 22 to guide ridge 16 into channel 20. There may be a second guide 24 proximate upper inner rim 23 to guide ridge 16 into channel 20. Ridge 16 may have one or more sealers 26 that are disposed circumferentially around ridge 16 on an exterior side 28 of the ridge 16 and/or on an interior side 30 of the ridge 16. The sealers 26 may engage the sides 32 of channel 20 when cap 12 is in the closed position with body 14, creating a friction fit or seal, thus preventing water or air from entering container 10.

Container 10 may have one or more distinct internal compartments 34 separated by zero or more dividers 36.

FIG. 1 is a schematic illustration and is not drawn to scale. Certain elements such as the outer perimeter of the cap walls, the inner perimeter of ridge 16, and the body perimeter formed by body walls 33 are seen best in other Figs., for example FIGS. 2 and 11.

Container 10 may be made from any suitable material, including plastic. The plastic may be strong, durable, and consumer-safe. Container 10 may be constructed with any process appropriate to the given material. In the case that container 10 is made of plastic, container 10 may be constructed using an injection molding process, among others.

Container 10 may serve a variety of purposes, determined by the user. For example, the user may wish container 10 to hold various tobacco products or rounds of ammunition. The size and exterior dimensions of container 10 and the configuration of the internal compartments 34 may be determined by the intended use of container 10. For example, a container 10 intended to hold rounds of ammunition may be taller than a container 10 intended to hold cigarettes. Further, internal compartments 34 configured to hold a cigarette may not securely hold a round of ammunition. Bottom portion 31 may be substantially flat, allowing container 10 to stand unsupported.

Figure 2:
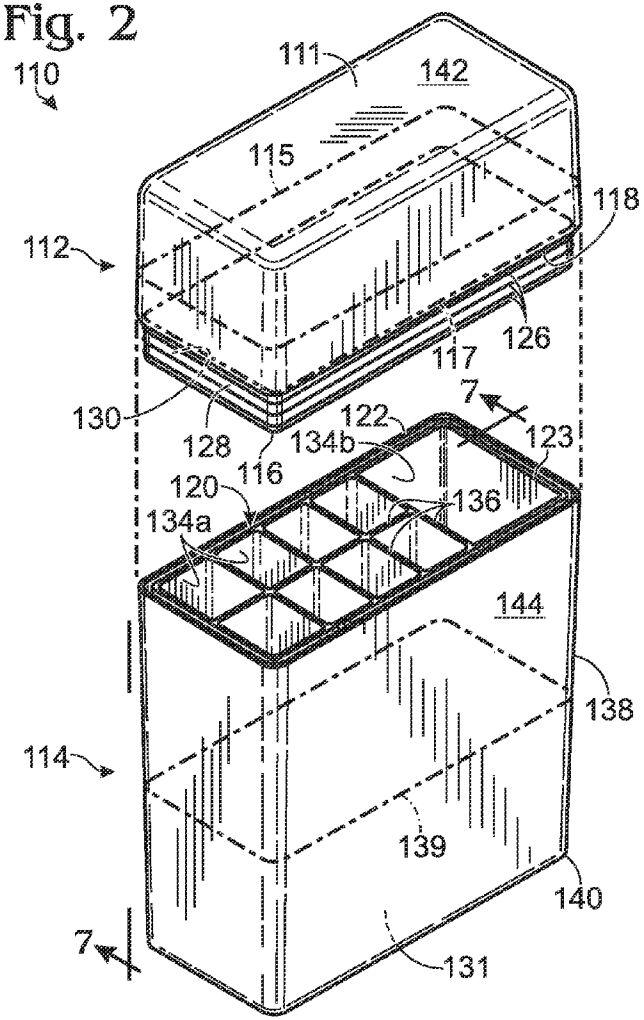
FIG. 2 shows a perspective view of an embodiment of a container with a cap and a body unattached.

FIG. 2 shows a first embodiment of container 110 in an unattached position, that is, where a cap 112 and a body 114 are separate from each other. Cap 112 may have a top portion 111 and an outer perimeter 115. A ridge or protruding end 116 may extend from a bottom edge 118 of cap 112 and form an inner perimeter 117. An exterior side 128 of ridge 116 may be lined with sealers 126. In this embodiment the sealers 126 are a set of three ribs 126 that protrude from the exterior side 128 of ridge 116. An interior side 130 of ridge 116 may be lined with sealers 126. In this embodiment the sealers 126 are a set of three ribs 126 that protrude from the interior side 130 of ridge 116. The interior side cannot be seen in FIG. 2 but can be seen in FIG. 4.

Body 114 may have a bottom portion 131 and a body perimeter 139. Body perimeter 139 may be substantially the same size at various points along the body. Body perimeter 139 may be substantially the same size as outer perimeter 115 of cap 112. Channel 120 may be disposed between an upper outer rim 122 and an upper inner rim 123 of body 114. Some or all exterior edges 138 and some or all exterior corners 140 of container 110 may be rounded. An exterior surface 142 of cap 12 and an exterior surface 144 of body 14 may be textured to improve a person's ability to grip container 110.

In this embodiment some of a set of internal compartments 134*a* may be configured to hold individual cigarettes, while another internal compartment 134*b* may be configured to hold matches or other igniting devices. The internal compartments 134*a* and 134*b* may be separated by dividers 136.

Figure 3:
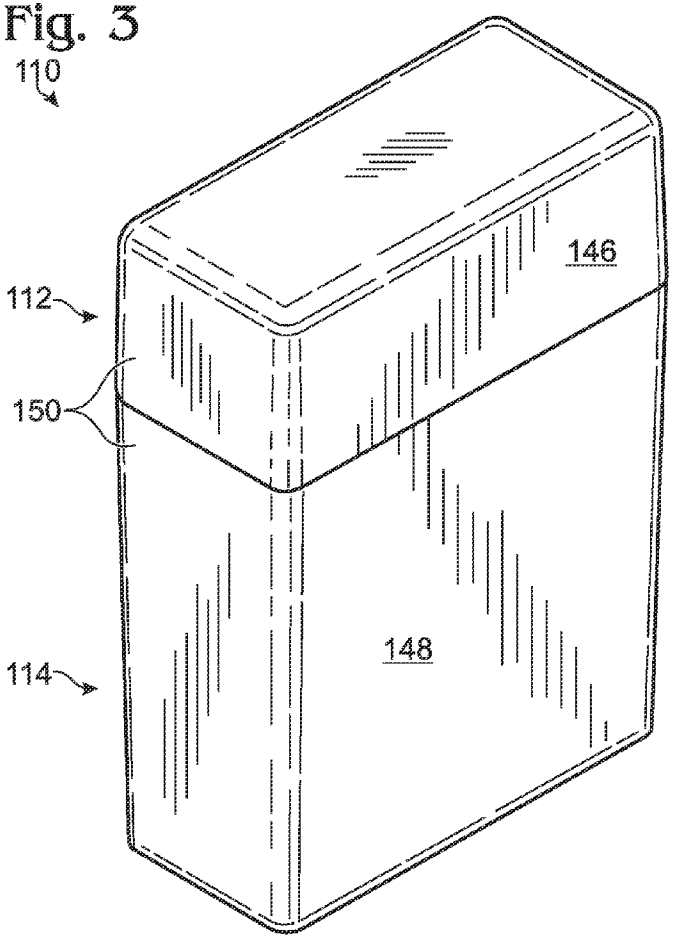
FIG. 3 shows a perspective view of the embodiment of FIG. 2 of the container with the cap and body attached in a closed position

FIG. 3 shows an embodiment of container 110 in a closed position, that is, where cap 112 and body 114 are connected. Cap 112 may fit flush with body 114. "Flush" means that an exterior side 146 of cap 112 and an exterior side 148 of body 114 form or substantially form one surface generally indicated at 150 when cap 112 is attached to body 114. Surface 150 may have no protrusions or other features where cap 112 and body 114 meet. Cap 112 and body 114 may fit flush on all four sides of container 110.

The features of container 110 may prevent container 110 from inadvertently opening while inside a larger container or in a person's pocket. When this embodiment of container 110 is in a closed position the external dimensions may be such that the width is about 1.54 inches, the length is about 2.6 inches, and the height is about 3.65 inches, subject to manufacturing tolerances. Other dimensions may be appropriate depending on the number and the size of the cigarettes container 110 is intended to hold.

Figure 4:
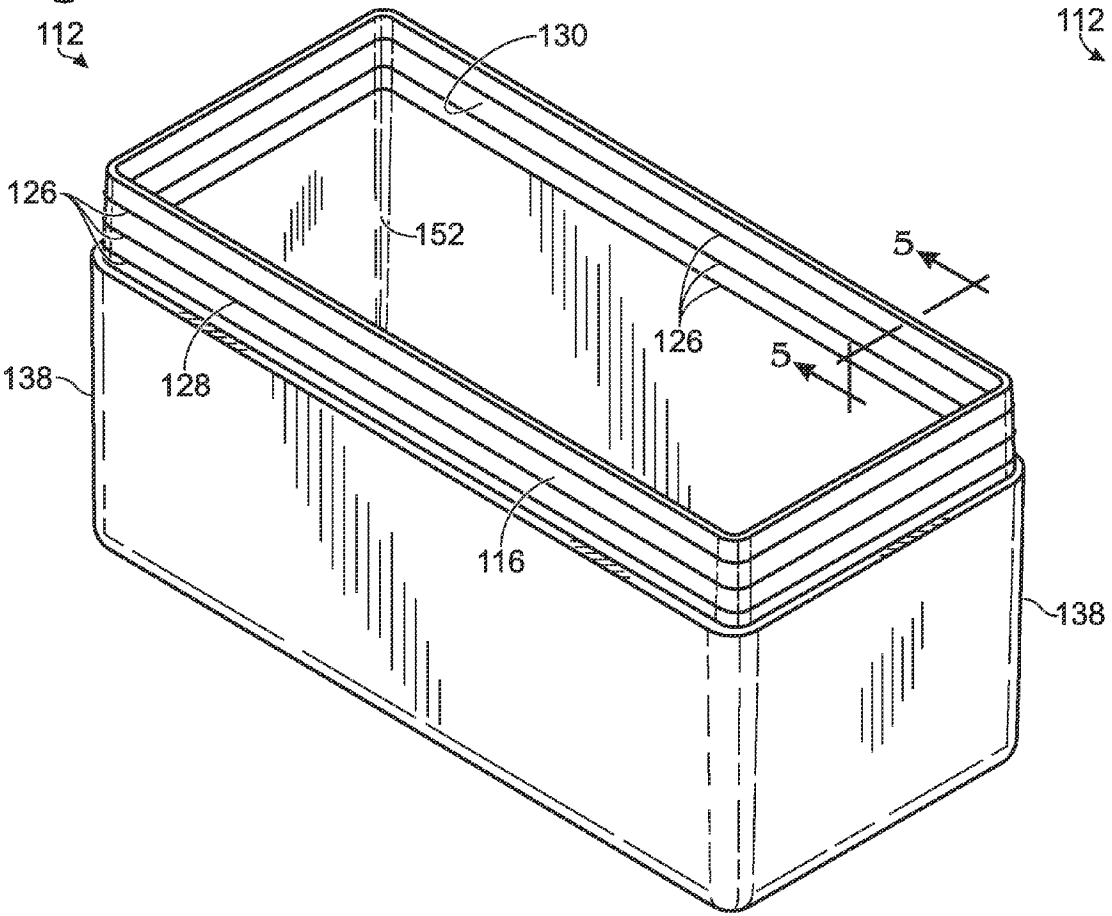
FIG. 4 shows a perspective view of the embodiment of the cap of FIG. 2.

FIG. 4 shows an embodiment of cap 112, having a set of three ribs 126 on the exterior side 128 of ridge 116 and a set of three ribs 126 on the interior side 130 of ridge 116. In addition to exterior edges 138 being rounded, all interior edges 152 may be rounded as well.

Figure 5:
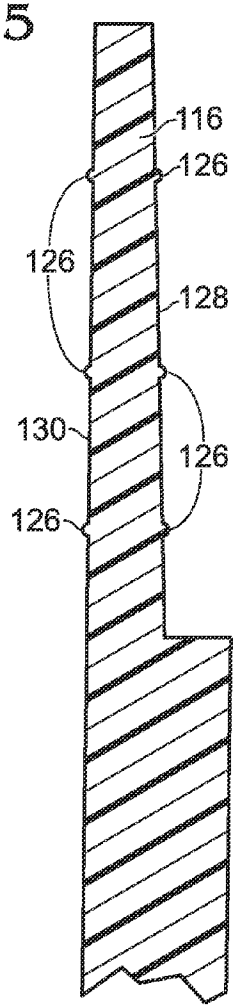
FIG. 5 shows a cross-sectional view, taken along plane 5-5 in FIG. 4, of a ridge extending from a bottom edge of the embodiment of the cap of FIG. 2.

FIG. 5 is a cross-sectional view, taken along plane 5-5 in FIG. 4, of the embodiment of ridge 116 on cap 112. On both the exterior side 128 and the interior side 130 of ridge 116 the ribs 126 may protrude from the surface of ridge 116.

Figure 6:
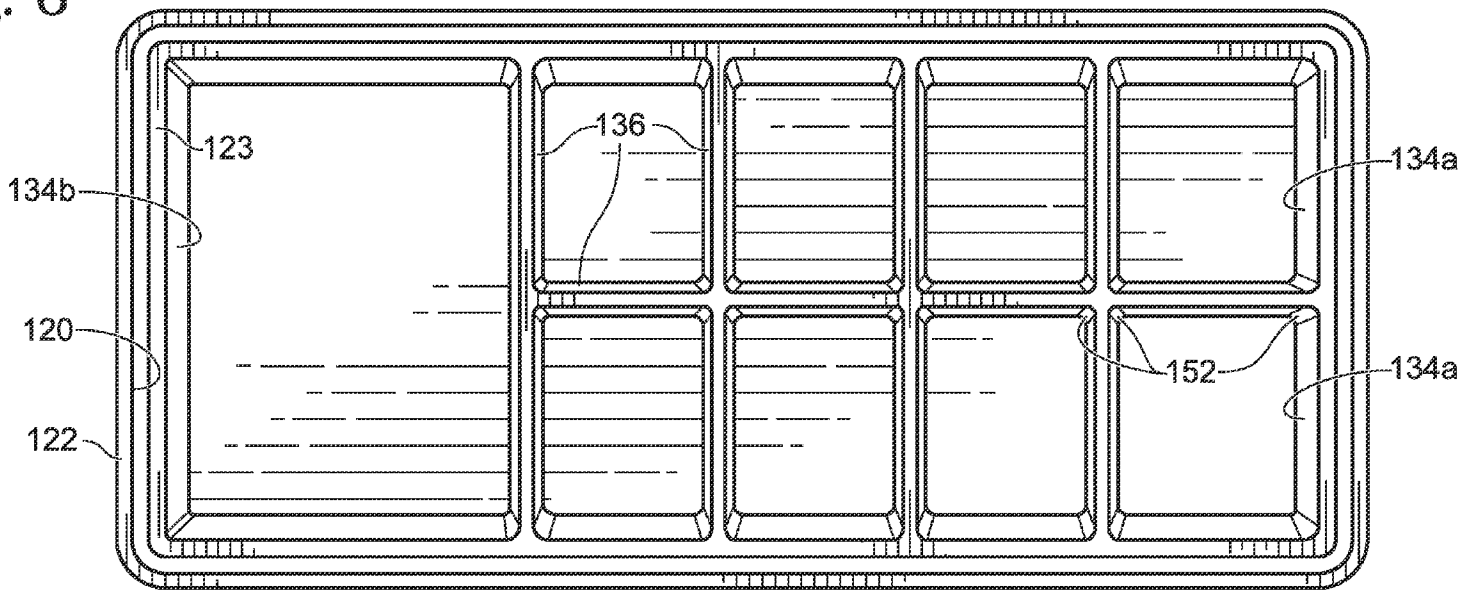
FIG. 6 shows a top view of the embodiment of the body of FIG. 2.

FIG. 6 shows a top down view of the embodiment of body 114 from FIG. 2. Channel 120 may be located between upper outer rim 122 and upper inner rim 123. The internal compartments 134*a* and 134*b* may be separated by dividers 136. The interior edges 152 where the dividers 136 meet each other or where the dividers 136 meet the interior walls of body 114 may be rounded.

Figure 7:
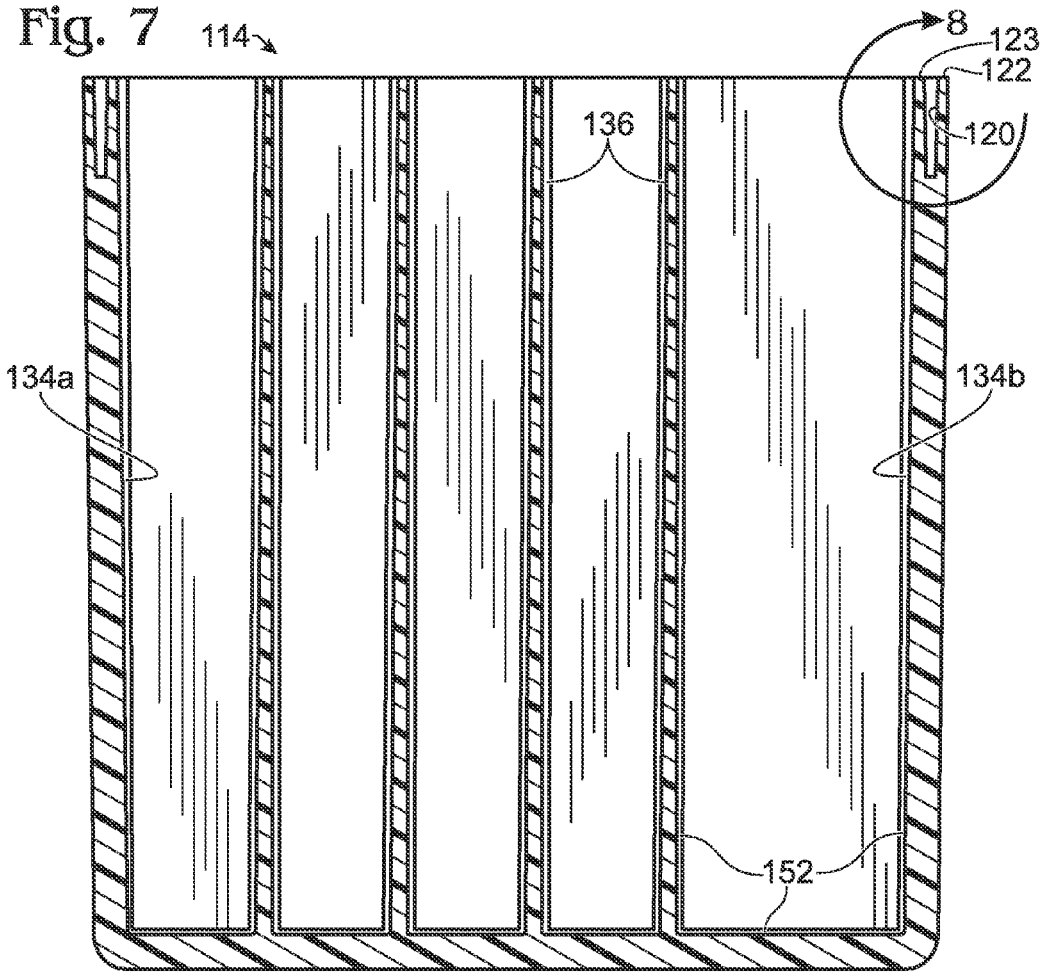
FIG. 7 shows a cross-sectional view, taken along plane 7-7 in FIG. 2, of the embodiment of the body.

FIG. 7 is a cross-sectional view, taken along plane 7-7 in FIG. 2, of an embodiment of body 114 of container 110. Channel 120 may be proximate upper outer rim 122 and upper inner rim 123. The dividers 136 may separate the internal space of body 114 into one or more compartments 134*a* sized to accept individual cigarettes, and/or into one or more compartments 134*b* sized to accept matches or other materials that could ignite a cigarette. The interior edges 152 where the dividers 36 meet each other, the walls, or the floor of body 114 may be rounded. This rounding of interior edges may serve to help protect the contents of internal compartments 134, and facilitate cleaning of internal compartments 134.

Figure 9:
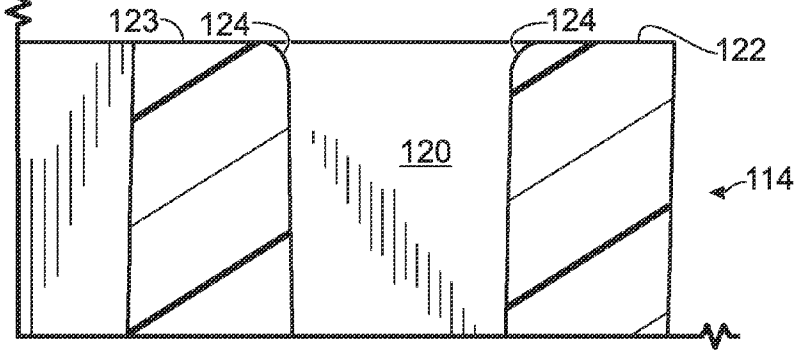
FIG. 9 shows a detailed view, taken at 9 in FIG. 8, of a cross-section of an embodiment of the body, showing a set of guides.
Figure 8:
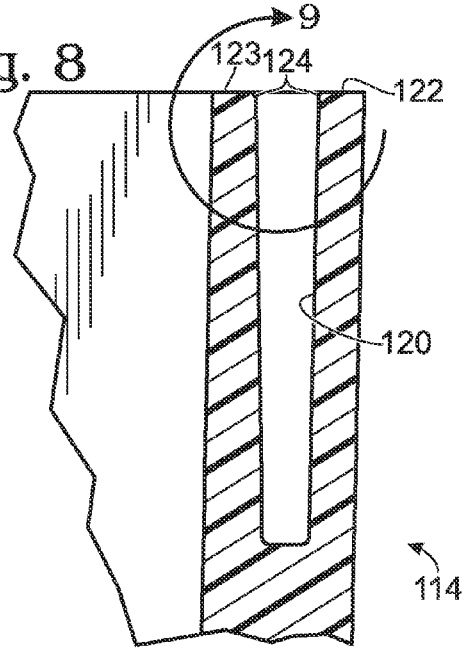
FIG. 8 shows a detailed view, taken at 8 in FIG. 7, of a cross-section of the embodiment of the body of the container, showing a channel set into a top edge of the body of the container.

FIG. 8 is a detailed view, taken at 8 in FIG. 7, of the upper outer rim 122 and upper inner rim 123 of the embodiment of body 114 of container 110. Channel 120 may be proximate upper outer rim 122 and upper inner rim 123. A first guide 124 may be proximate where upper outer rim 122 meets channel 120. A second guide 124 may be proximate where upper inner rim 123 meets channel 120. As best seen in FIG. 9 the guides 124 may be rounded edges. Guides 124 may help ridge 116 (not shown) slide into channel 120 in order to close container 110.

FIG. 9 is an even more detailed view, taken at 9 in FIG. 8, of upper outer rim 122, upper inner rim 123, channel 120 and guides 124.

Figure 10:
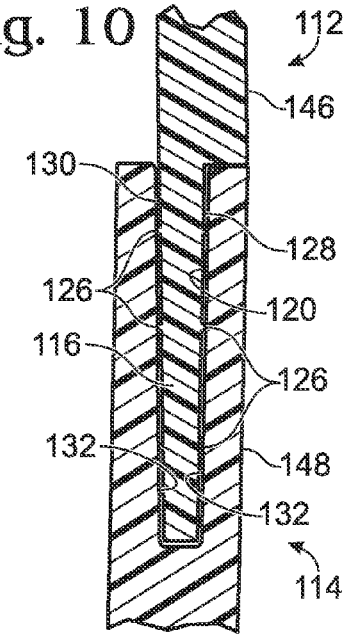
FIG. 10 shows a cross-sectional view of the embodiment of the container in the closed position, showing the ridge on the cap inserted into the channel in the body.

FIG. 10 is a detailed cross-sectional view of the embodiment of container 110 when the ridge 116 of cap 112 has been inserted into the channel 120 of body 114. The ribs 126 that extend from the exterior side 128 of ridge 116 may be in physical contact with the sides 132 of channel 120. The ribs 126 that extend from the interior side 130 of ridge 116 may be in physical contact with the sides 132 of channel 120. This contact may create a friction fit or seal. This contact may create an air-tight or a water-tight seal that would prevent water or air from entering container 110. The exterior side 146 of cap 112 may fit flush with the exterior side 148 of body 114.

Figure 11:
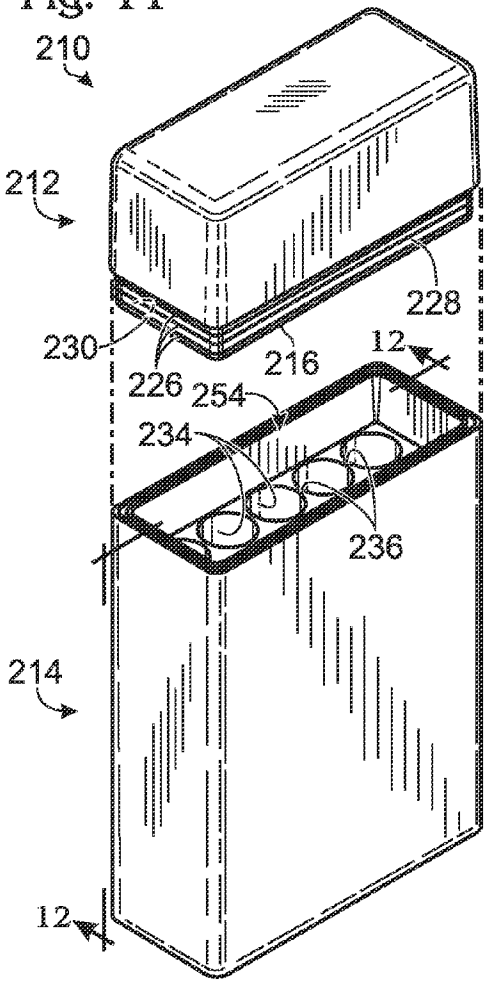
FIG. 11 shows a perspective view of another embodiment of a container with a cap and a body unattached.

FIG. 11 shows another embodiment of a container 210 in an unattached position, that is, where a cap 212 and a body 214 are not connected. Most of the features of this embodiment may be the same or similar to the embodiment described above and shown in FIGS. 1 through 9. For example, cap 212 may have a first set of sealers 226 on an exterior side 228 of a ridge 216 and a second set of sealers 226 on an interior side 230 of ridge 216 (not visible in this Fig., see FIG. 4 for a view of both sets of sealers 226). The primary differences between the two embodiments are the configuration of a set of internal compartments 234 and a set of dividers 236 that separate them, and the exterior dimensions of container 210. In this embodiment the internal compartments 234 may be configured to hold rounds of ammunition or bullets. As can be seen in FIG. 11 the internal compartments 234 may have a generally cylindrical shape. Further, there may be an open space 254 in body 214 above the internal compartments 234. One purpose of this space will be made clear with FIG. 12. When this embodiment of container 210 is in a closed position the external dimensions may be such that the width is about 1.26 inches, the length is about 3.0 inches, and the height is about 5.0 inches, subject to manufacturing tolerances. Other dimensions may be appropriate depending on the number and the size of the rounds of ammunition container 210 is intended to hold.

Figure 12:
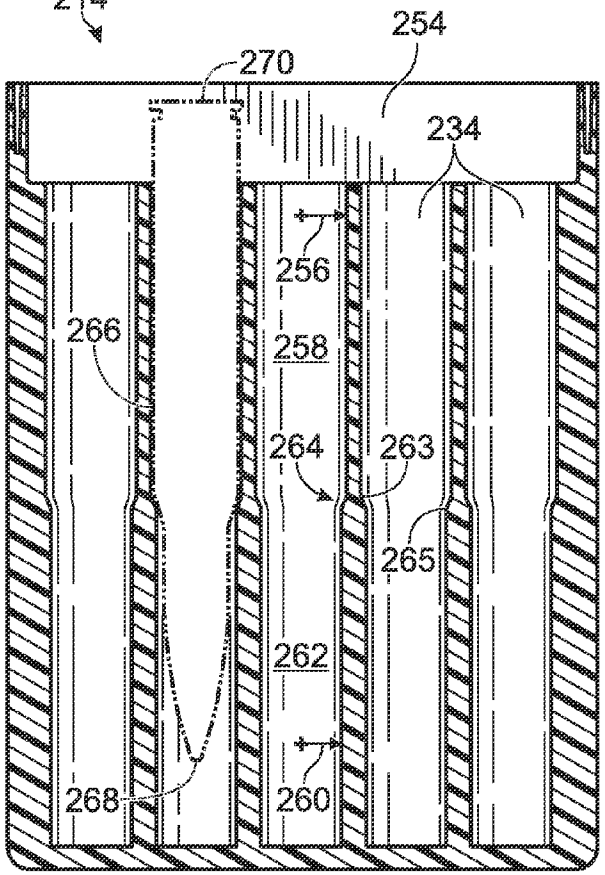
FIG. 12 shows a cross-sectional view, taken along plane 12-12 in FIG. 11, of the embodiment of the body of FIG. 11.

FIG. 12 is a cross-sectional view, taken at plane 12-12 in FIG. 11, of body 214. In this embodiment the internal compartments 234 are generally cylindrical. The internal compartments may have a radius 256 of an upper portion 258 that is slightly larger than a radius 260 of a lower portion 262 and a region 264 where the radius changes. An edge 263 between upper portion 258 and region 264 may be rounded. Another edge 265 between region 264 and lower portion 262 may also be rounded. A top edge 256 of internal compartment 234 where upper portion 258 meets open space 254 may also be rounded. The dashed line in FIG. 12 indicates a round of ammunition or bullet 266 as it would sit in container 210. All dimensions of an internal compartment 234, including the depth, radius 256 of the upper portion 258, radius 260 of the lower portion 262, and location of the region 264 where the radius changes may be chosen so that a round of ammunition would sit securely as indicated, namely that an end 268 of the round 266 does not rest on the bottom of container 210 and so that an upper rim 270 of the round 266 protrudes up into the open space 254 above the internal compartments 234. This may facilitate removal of round 266 from container 210. Other configurations of the internal compartments 234 to hold the bullet in other desired positions can also be utilized, as desired.

Figure 13:
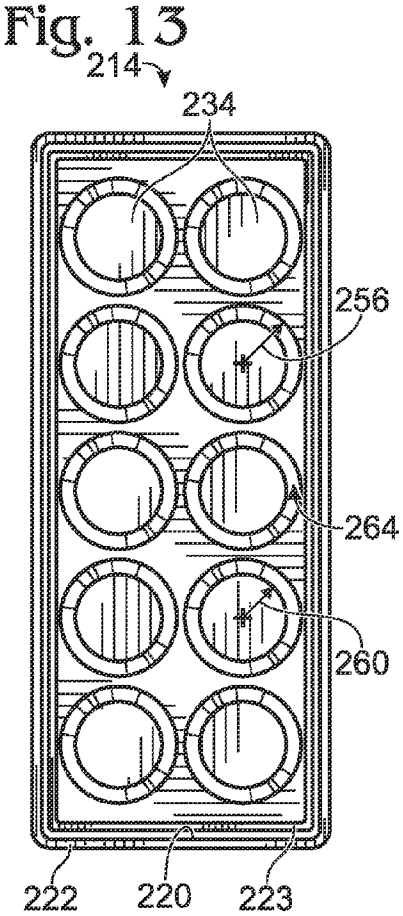
FIG. 13 shows a top view of the embodiment of the body of FIG. 11.

FIG. 13 is a top down view of an embodiment of the body 214 of container 210. Channel 220 may be proximate an upper outer rim 222 and an upper inner rim 223. In this embodiment the internal compartments 234 may be configured to hold rounds of ammunition. The internal compartments 234 may be generally cylindrical with a larger radius 256 towards the top of the compartment, a region 264 where the radius decreases, and with a smaller radius 260 towards the bottom of the compartment.

Figure 14:
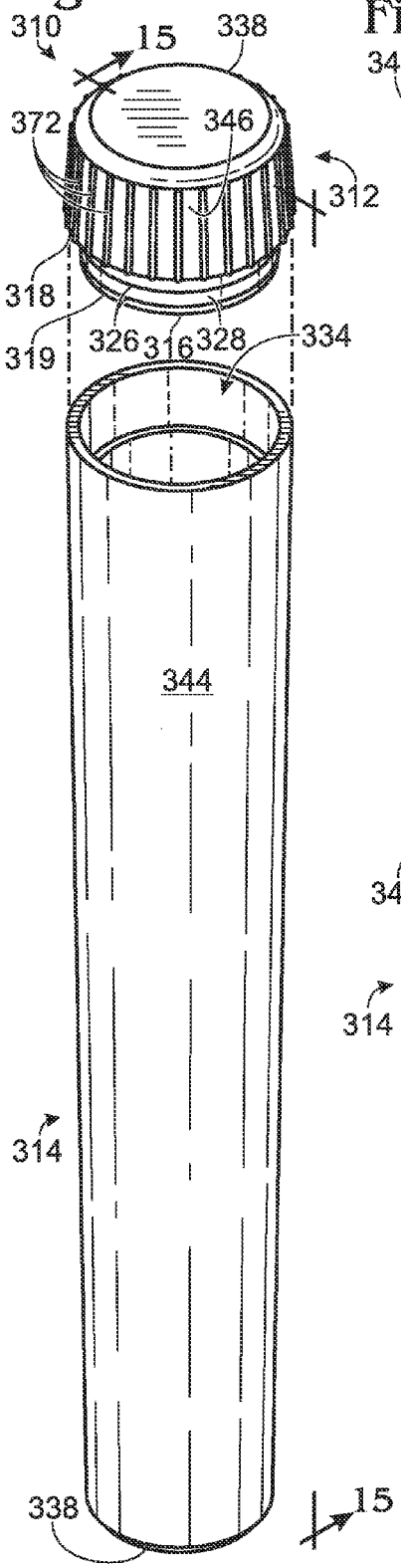
FIG. 14 shows a perspective view of another embodiment of a container with a cap and a body unattached.

FIG. 14 is a perspective view of another embodiment of a container 310 where a cap 312 is separate from a body 314. In this embodiment container 310 is configured to hold a single cigar. Cap 312 may have a ridge 316 that extends from a bottom edge 318. An outer edge 319 of ridge 316 may be angled or chamfered. The ridge may have sealers 326 disposed circumferentially around an exterior side 328 of ridge 316. When cap 312 is placed on body 314 to close container 310 the sealers may engage with the interior surface of body 314. In this embodiment the sealers 326 may be a set of three ribs that protrude from the surface of the exterior side 328 of ridge 316. Cap 312 and body 314 may be generally cylindrical in shape and body 314 may have only one internal compartment 334. Cap 312 may have a set of vertical ribs 372 that are disposed on an exterior side 346 of cap 312. These vertical ribs may extend out from the surface of the exterior side 346 of cap 312 and may be spaced regularly around the circumference of cap 312. Vertical ribs 372 may make it easier to remove cap 312 from body 314. The exterior surface 344 of body 314 may be textured to improve a person's ability to grip container 310. Circular edges 338 of container 310 at the top of cap 312 and the bottom of body 314 may be rounded.

Figure 15:
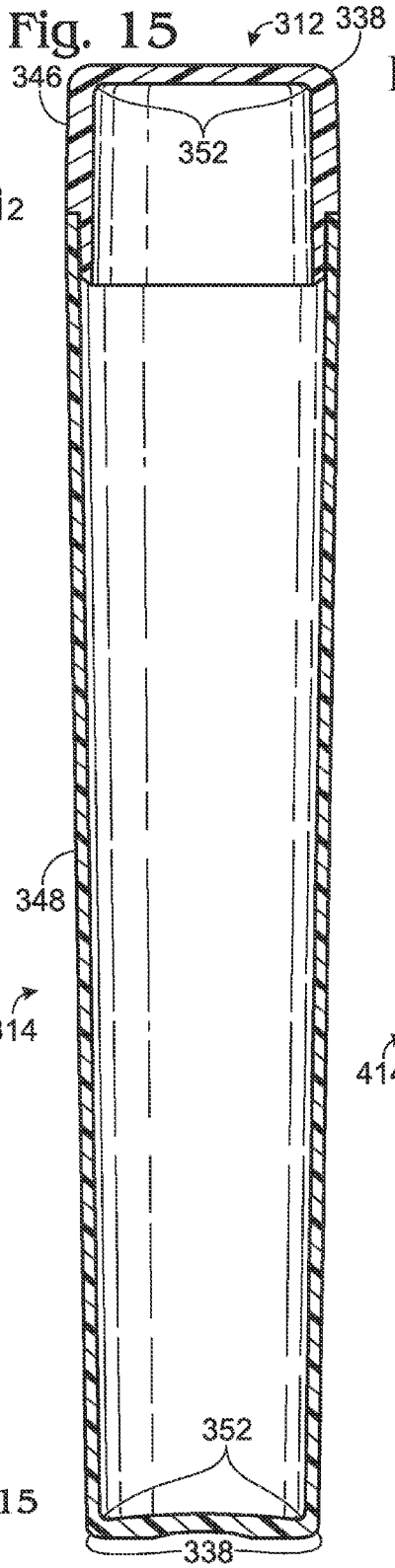
FIG. 15 shows a cross-sectional view, taken along plane 15-15 in FIG. 14, of the embodiment of the container of FIG. 14 with the cap and body attached in a closed position.

FIG. 15 is a cross-sectional view, taken at 15-15 in FIG. 14, of the third embodiment of container 310. Cap 312 is attached to body 314 in a closed position in this view. The angled outer edge 319 may help guide cap 312 into the closed position with body 314. The top inner edge of body 314 may also be beveled to help guide cap 312 into the closed position with body 314. The edges of this bevel may be rounded. An exterior side 346 of cap 312 may fit or substantially fit flush with an exterior side 348 of body 314. Exterior edges 338 and interior edges 352 may be rounded. When this embodiment of container 310 is in an attached position the external dimensions may be such that the diameter is about 1.2 inches and the height is about 7.05 inches, subject to manufacturing tolerances. Other dimensions may be appropriate depending on the size of the cigar, cigarette, or other rolled tobacco product container 310 is intended to hold.

Figure 16:
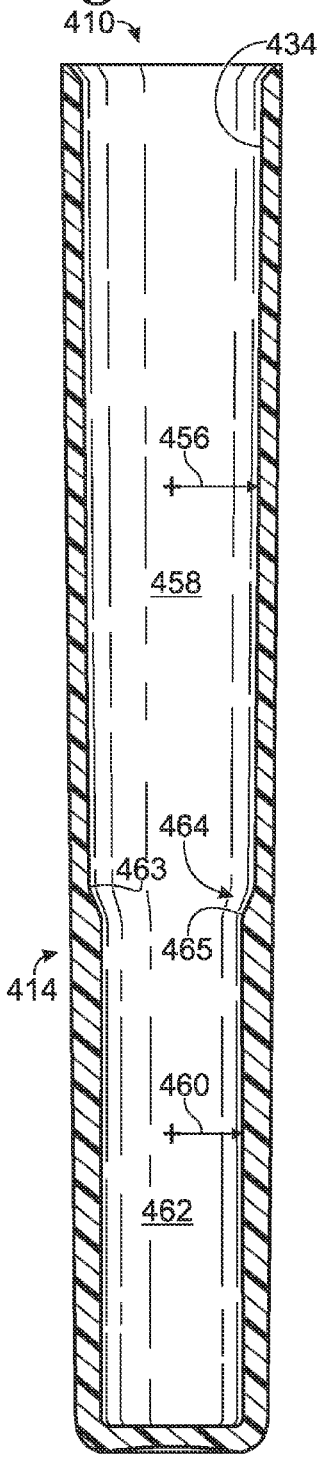
FIG. 16 shows a cross-sectional view of another embodiment of a body.

FIG. 16 is a cross-sectional view of another embodiment of a body 414 of a container 410. The general shape of this fourth embodiment 410 is similar to the embodiment 310 described above and in FIGS. 14 and 15. The primary difference is the shape of an internal compartment 434. Similarly to a previously described embodiment 210, the internal compartment 434 may be configured to hold a single round of ammunition. Internal compartment 434 is generally cylindrical with a radius 456 of an upper portion 458 that is larger than a radius 460 of a lower portion 462, and a region 464 where the radius decreases. An edge 463 between upper portion 458 and region 464 may be rounded. Another edge 465 between region 464 and lower portion 462 may also be rounded. When this embodiment of container 410 is in an attached position the external dimensions may be such that the diameter is about 0.67 inches and the height is about 5.6 inches, subject to manufacturing tolerances. Other dimensions may be appropriate depending on the size of the round of ammunition container 310 is intended to hold. Further, radius 456, radius 460, and the location of region 464 may be configured to accommodate a particular round of ammunition.

While embodiments of one or more containers have been particularly shown and described, many variations may be made therein. This disclosure may include one or more independent or interdependent embodiments directed to various combinations of features, functions, elements and/or properties. Other combinations and sub-combinations of features, functions, elements and/or properties may be claimed later in a related application. Such variations, whether they are directed to different combinations or directed to the same combinations, whether different, broader, narrower or equal in scope, are also regarded as included within the subject matter of the present disclosure. Accordingly, the foregoing embodiments are illustrative, and no single feature or element, or combination thereof, is essential to all possible combinations that may be claimed in this or a later application.

It is believed that the disclosure set forth herein encompasses multiple distinct inventions with independent utility. While each of these inventions has been disclosed in its preferred form, the specific embodiments thereof as disclosed and illustrated herein are not to be considered in a limiting sense as numerous variations are possible. Each example defines an embodiment disclosed in the foregoing disclosure, but any one example does not necessarily encompass all features or combinations that may be eventually claimed. Where the description recites "a" or "a first" element or the equivalent thereof, such description includes one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

What is claimed is:

1. A container, comprising:

a cap that includes:

a top portion, cap walls that extend from the top portion and form an outer perimeter, and a protruding end, extending from the cap walls in an opposite direction from the top portion, the protruding end forming an inner perimeter that is sized smaller than the outer perimeter; and a body that includes:

a bottom floor portion, body walls extending from the bottom floor portion from proximal ends of the body walls to distal outermost ends of the body walls, the body walls forming a cavity on an inner side and a body perimeter on an outer side, the body perimeter having a substantially consistent size between the proximal and distal outermost ends of the body walls, an upper outer rim formed proximate outermost edges of the distal outermost ends, and an upper inner rim formed proximate inner edges of the distal outermost ends, the upper outer and inner rims being disposed around the entire distal outermost ends and having a channel between the upper outer and inner rims, the channel being disposed entirely within the body perimeter, the channel having a floor, an opening proximate the upper outer and inner rims, an inner wall, and an outer wall, each of the inner and outer walls extending in a single continuous arc between the floor of the channel and the opening of the channel, the channel sized to receive the protruding end in a friction seal when the container is in a closed position.

2. The container of claim 1, wherein the channel is disposed entirely within the body walls between the outer perimeter and the inner side of the body walls.

3. The container of claim 2, wherein no portion of the cap extends beyond the body perimeter in the closed position and the cavity is airtight and waterproof when the container is in the closed position.

4. The container of claim 1, further comprising one or more first friction sealer(s) disposed on a first side of the protruding end, and one or more second friction sealer(s) disposed on a second side of the protruding end that is opposite the first side.

5. The container of claim 4, wherein the one or more first and second friction sealers are flexible ribs that flex to form the friction seal within the channel when the container is in the closed position.

6. The container of claim 1, wherein the upper inner rim is a rounded edge adapted to guide the protruding end from an unclosed position to the closed position and the upper outer rim is a rounded edge adapted to guide the protruding end from the unclosed position to the closed position.

7. The container of claim 1, wherein the protruding end is friction sealed within the channel in the closed position without an adhesive applied to the channel.

8. The container of claim 1, wherein the cavity includes at least one compartment sized to receive one cigarette and at least one compartment sized to receive a book of matches.

9. The container of claim 1, wherein the cavity includes one or more compartments, each compartment sized to receive a single round of ammunition.

10. The container of claim 1, wherein the cavity includes one or more compartments, each compartment having a bottom chamber wall portion of a first diameter, and a top chamber wall portion of a second diameter larger than the first diameter, wherein the top and bottom chamber wall portions are adapted to hold a round of ammunition in a suspended position, such that a projectile end of the round of ammunition extends downward into the bottom chamber wall portion without contacting the bottom floor portion and an upper rim of a casing of the round of ammunition extends above the top chamber wall portion into an open space above the respective compartment and below the distal outermost ends of the body walls.

11. The container of claim 10, wherein each compartment includes a transition wall area between the top chamber wall portion and the bottom chamber wall portion, the transition wall area having a third diameter that is larger than the first diameter and smaller than the second diameter.

12. A container, comprising:

a cap that includes:

a top portion, cap walls that extend from the top portion and form an outer perimeter, and a protruding end, extending from the cap walls in an opposite direction from the top portion, the protruding end forming an inner perimeter that is sized smaller than the outer perimeter, the protruding end having one or more first friction sealer(s) disposed on a first side of the protruding end and one or more second friction sealer(s) disposed on a second side of the protruding end that is opposite the first side; and a body that includes:

a bottom floor portion, body walls extending from the bottom floor portion from proximal ends of the body walls to distal outermost ends of the body walls, the body walls forming a cavity on an inner side and a body perimeter on an outer side, the body perimeter having a substantially consistent size between the proximal and distal outermost ends and being sized substantially the same as the outer perimeter, an upper outer rim formed proximate outermost edges of the distal outermost ends and having a first guide adapted to guide the protruding end from an unclosed position to a closed position, and an upper inner rim formed proximate innermost edges of the distal outermost ends having a second guide adapted to guide the protruding end from the unclosed position to the closed position, the upper outer and inner rims being disposed around the entire distal outermost ends and having a channel between the upper outer and inner rims, the channel sized to receive the protruding end in a friction seal, without an adhesive applied to the channel, when the container is in the closed position, the channel being disposed entirely between the inner side and the body perimeter and inside the body walls, the channel having a floor, an opening proximate the upper outer and inner rims, a set of inner walls, and a set of outer walls, each of the inner and outer walls respectively being a substantially smooth plane between the floor of the channel and the opening of the channel, wherein, in the closed position, the cap and the body form a flush fit, the cavity is waterproof and airtight, and no portion of the cap is configured to extend beyond the body perimeter in the closed position.

13. The container of claim 12, wherein the first sealer is one or more ribs protruding from the interior side of the protruding end and the second sealer is one or more ribs protruding from the exterior side of the protruding end; and the first and second guides are each rounded edges.

14. The container of claim 13, wherein the cavity includes one or more compartments extending from the bottom floor portion, each compartment having a bottom chamber wall portion of a first diameter, and a top chamber wall portion of a second diameter larger than the first diameter, wherein the compartment is adapted to hold a round of ammunition in a suspended position, such that a projectile end of the round of ammunition extends downward into the bottom chamber wall portion without contacting the bottom floor portion or the bottom chamber wall portion and an upper rim of a casing of the round of ammunition extends above the top chamber wall portion into an open space above the compartments and below the distal outermost ends of the body walls, further wherein each compartment includes a transition wall portion between the top chamber wall portion and the bottom chamber wall portion, the transition wall portion having a flat angled wall portion, a first rounded edge between the top chamber wall portion and the flat angled wall portion, and a second rounded edge between the flat angled wall portion and the bottom chamber wall portion, further wherein the transition wall area has a third diameter that is larger than the first diameter and smaller than the second diameter.

15. The container of claim 1, wherein each of the inner and outer walls respectively are substantially straight between the floor of the channel and the opening of the channel.

16. The container of claim 15, wherein each of the inner and outer walls respectively form a substantially smooth plane between the floor of the channel and the opening of the channel.

17. The container of claim 16, further comprising one or more first friction sealer(s) disposed on a first side of the protruding end, wherein the one or more first friction sealer(s) makes contact with, but does not protrude through, respective surface areas of the inner and outer channel walls.

* * * * *